US009961997B2

(12) United States Patent
Rioja Calvo

(10) Patent No.: US 9,961,997 B2
(45) Date of Patent: May 8, 2018

(54) ALIGNMENT DEVICE FOR JOINING TOGETHER PARTS OF FURNITURE

(71) Applicant: INDUSTRIAS AUXILIARES, S.A. (INDAUX), Getaria (ES)

(72) Inventor: Miguel Angel Rioja Calvo, Zarautz (ES)

(73) Assignee: INDUSTRIAS AUXILIARES, S.A. (INDAUX), Getaria (ES)

( * ) Notice: Subject to any disclaimer, the term of this patent is extended or adjusted under 35 U.S.C. 154(b) by 369 days.

(21) Appl. No.: 14/695,155

(22) Filed: Apr. 24, 2015

(65) Prior Publication Data

US 2015/0305499 A1 Oct. 29, 2015

(30) Foreign Application Priority Data

Apr. 25, 2014 (ES) ..... 201430617

(51) Int. Cl.
*A47B 88/956* (2017.01)
*A47B 88/00* (2017.01)
*A47B 96/20* (2006.01)

(52) U.S. Cl.
CPC ..... *A47B 88/0055* (2013.01); *A47B 88/956* (2017.01); *A47B 96/20* (2013.01); *A47B 2230/0003* (2013.01); *A47B 2230/0022* (2013.01)

(58) Field of Classification Search
CPC ..... A47B 96/20; A47B 2230/0003; A47B 2230/0022; A47B 88/0055; A47B 88/956
See application file for complete search history.

(56) References Cited

U.S. PATENT DOCUMENTS 5,002,346 A * 3/1991 Gasser ..... A47B 88/956 312/348.4
5,163,774 A * 11/1992 Lautenschlager .... A47B 88/956 312/330.1
5,364,181 A * 11/1994 Scheible ..... A47B 88/956 312/348.4

(Continued)

FOREIGN PATENT DOCUMENTS

AT 510954 A4 * 8/2012 ..... A47B 88/0055
CH 700977 A1 * 11/2010 ..... F16B 12/2027

(Continued)

*Primary Examiner* — Benjamin F Fiorello
(74) *Attorney, Agent, or Firm* — Barnes & Thornburg LLP; Mark J. Nahnsen

(57) ABSTRACT

Adjustable connecting device comprised by an alignment body provided with at least one vertical adjustment channel in one of its surfaces which is capable of receiving the sliding piece for vertical adjustment; said alignment body having at least one vertical adjustment aperture in its surface, which aperture coincides with the position of the toothed rack of the sliding piece for vertical adjustment and is capable of receiving the vertical toothed adjustment pinion whose toothing corresponds to the toothing of the toothed rack; said sliding piece for vertical adjustment being provided with the corresponding slot-shaped aperture in the transverse direction and the corresponding toothed rack; wherein the adjustment device is completed by the fastening screw for fastening the decorative drawer front which secures the decorative drawer front.

8 Claims, 4 Drawing Sheets

(56) References Cited

U.S. PATENT DOCUMENTS

| | | | | | |
|---|---|---|---|---|---|
| 5,611,637 | A * | 3/1997 | Brustle | A47B 88/00 | 312/111 |
| 5,860,718 | A * | 1/1999 | Brustle | A47B 88/956 | 312/330.1 |
| 5,895,103 | A * | 4/1999 | Huber | A47B 88/95 | 312/348.4 |
| 8,047,621 | B2 * | 11/2011 | Walburn | A47B 88/956 | 312/265.5 |
| 2014/0239787 | A1 * | 8/2014 | Mensa' | A47B 88/0055 | 312/348.4 |
| 2015/0359334 | A1 * | 12/2015 | Salice | F16B 12/46 | 312/348.4 |

FOREIGN PATENT DOCUMENTS

| | | | | |
|---|---|---|---|---|
| DE | 29521059 | U1 * | 12/1996 | A47B 88/956 |
| EP | 0510346 | A1 * | 10/1992 | A47B 88/956 |
| WO | WO 2010049436 | A1 * | 5/2010 | A47B 88/956 |

* cited by examiner

ALIGNMENT DEVICE FOR JOINING TOGETHER PARTS OF FURNITURE

CROSS REFERENCE TO RELATED APPLICATIONS

This application claims priority to Spanish patent application no. 201430617, filed Apr. 25, 2014. The disclosure in the referenced application is herein incorporated by reference in its entirety.

FIELD OF THE INVENTION

The present invention relates to an alignment device for joining together parts of furniture, of the type used to adjust the decorative front of a drawer or the like.

BACKGROUND

At present and according to the state of the art, it is known to use systems for the adjustment and alignment of the decorative front of drawers having a four-sided structure.

Among others, the utility model ES256199U describes a centring device of for adjusting drawer fronts made up of two pieces, of which one serves as a base and is installed fixed on the drawer front and the other is located within the first one, allowing to modify the position, the latter piece being equipped with a fastening screw which ensures the proper position. This system has the drawback that it lacks precision, as adjustment is done without method.

SUMMARY

In illustrative embodiments, an alignment device is used to join together parts of furniture, of the type used to adjust the decorative front of a drawer or the like, wherein, embedded in the front side of the drawer structure, at least one adjustable connecting device is provided which is comprised by an alignment body provided with at least one vertical adjustment channel in one of its surfaces which is capable of receiving the sliding piece for vertical adjustment. The alignment body includes at least one vertical adjustment aperture in its surface, which aperture coincides with the position of the toothed rack of the sliding piece for vertical adjustment and is capable of receiving the vertical toothed adjustment pinion whose toothing corresponds to the toothing of the toothed rack. The sliding piece is provided with a corresponding slot-shaped aperture in the transverse direction and the corresponding toothed rack.

The adjustment device is completed by use of a fastening screw for fastening the decorative drawer front which, extends through the slot-shaped aperture provided in the sliding piece for vertical adjustment and the window of the alignment body, secures the decorative drawer front. In addition, the alignment device can include a horizontal adjustment channel extending through the inside of the alignment body that is capable of receiving the sliding piece for horizontal adjustment. The alignment body includes at least one horizontal adjustment aperture in its surface, which aperture coincides with the position of the toothed rack of the sliding piece for horizontal adjustment and is capable of receiving the horizontal toothed adjustment pinion whose toothing corresponds to the toothing of the toothed rack. The sliding piece for horizontal adjustment is provided with a corresponding slot-shaped aperture in the transverse direction and the corresponding toothed rack.

In this configuration, an adjustment device is achieved which is easy to fit to the drawer by applying pressure, without the need to use a wood screw or other fastening elements. One must only make two apertures in the drawer structure to which the decorative front is coupled, in order to insert the alignment bodies. By using sliding pieces for vertical and horizontal adjustment, the position of the drawer front can be adjusted in both directions by means of two adjustment devices. In addition, since both sliding pieces used for adjustment are geometrically identical, a device is achieved which can be produced more economically are compatible for both vertical and horizontal adjustment, as only a single type of piece needs to be produced.

In addition, a system for horizontal and vertical adjustment is made available which is easy to operate, as only conventional tightening tools (screwdrivers, Allen key, etc.) are required to act upon the toothed adjustment pinions, thus bringing about movement of the decorative drawer front in the vertical and horizontal direction.

The adjustment device is completed by the fastening screw for fastening the decorative drawer front which, extending through the slot-shaped apertures provided in each of the sliding pieces for vertical and horizontal adjustment and the window of the alignment body, secures the decorative drawer front.

By means of this configuration, the decorative drawer front can be secured easily and rapidly once it is in the correct position, thus preventing it from moving out of place again. It is convenient to make two apertures in the decorative front, for the reception of two nuts with an external thread which is suitable for fastening to wood or chipboard and a thread suitable for screws with metal thread on the inside.

Another advantage of the device is that at least the bottom of the vertical adjustment channel is provided with a safety toothing which is complementary to the safety toothing provided on the sliding piece for vertical adjustment, which are capable of engaging each other when the fastening screw is tightened.

IN this configuration, the decorative drawer front will not move out of place in the vertical direction once it has been secured by means of the fastening screws, for example due to its own weight in case of large drawers or to improper use by its users.

Finally, another feature of this design is that the toothed adjustment pinions, in their front surfaces, include grooves corresponding to the active tip of a screwdriver or "Allen" key.

This and other special features of the invention will be described in the detailed explanation provided below, with reference to the annexed illustrations.

BRIEF DESCRIPTION OF THE DRAWINGS

For an improved understanding of the nature of the invention, the annexed drawings show a preferred industrial embodiment, which is a purely illustrative and non-limiting example.

Figure 1:
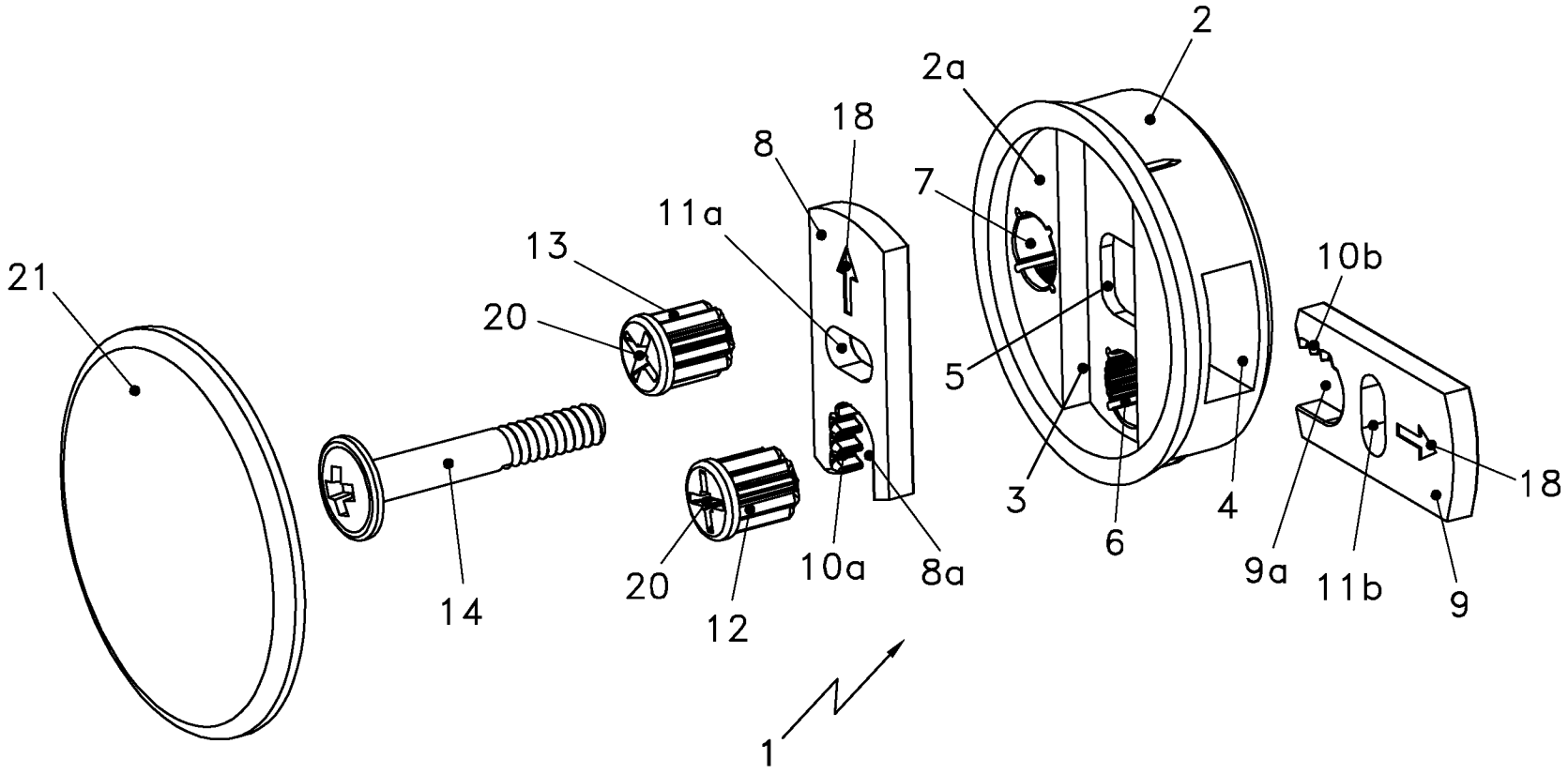
FIG. 1 shows an exploded overall view of the adjustment device in which the component parts can be seen. The shown embodiment corresponds to the use of adjustment pinions and sliding pieces for adjustment.
Figure 2:
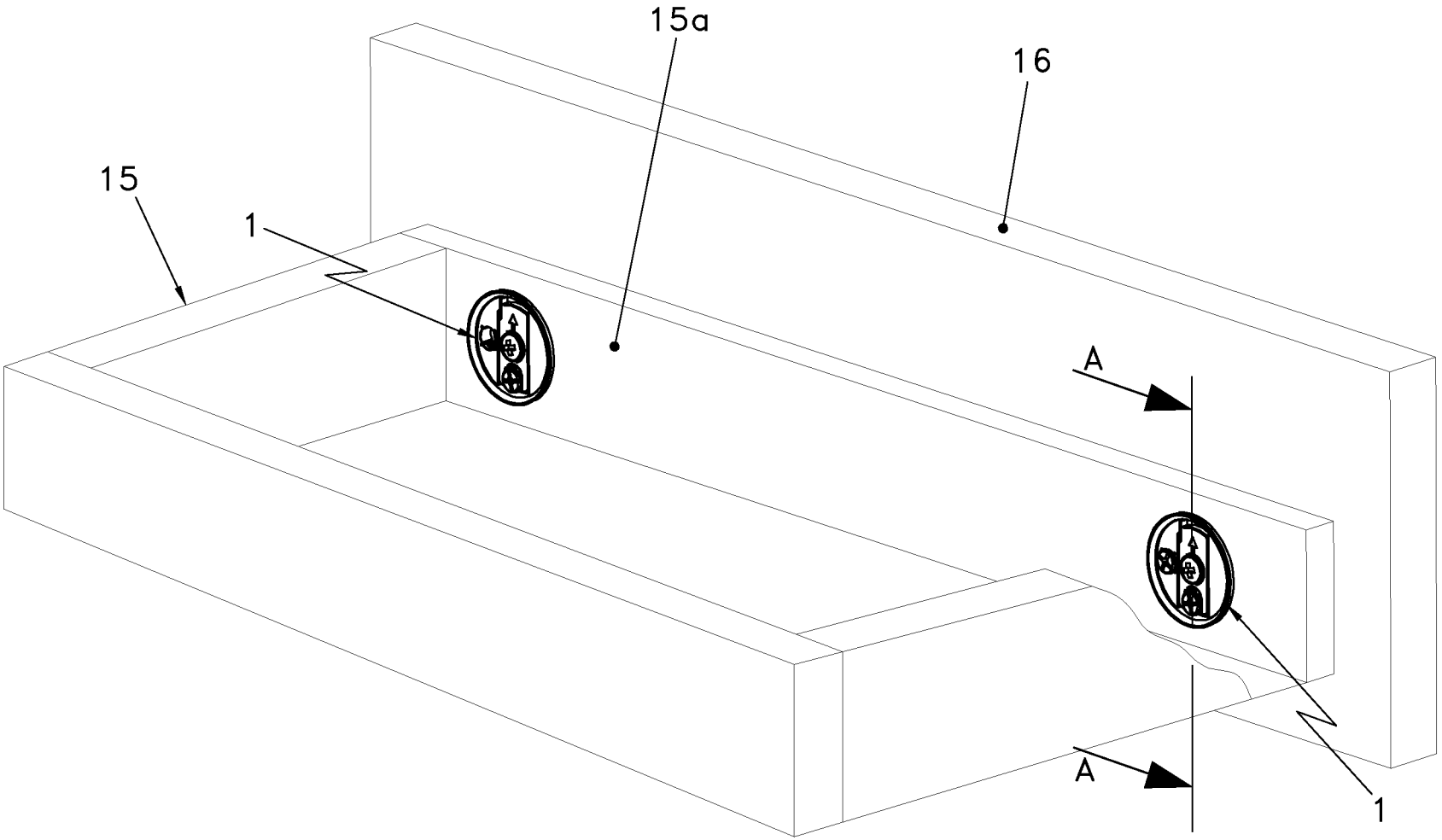
FIG. 2 shows an isometric view of the adjustment devices mounted to the front side of the drawer structure, the decorative drawer front being adjusted and secured in position.

In these figures, the following reference numerals are shown:

1.—Adjustable connecting device.
2.—Alignment body.
2*a*.—Front surface.
3.—Channel for vertical adjustment.
4.—Channel for horizontal adjustment.
5.—Window of the alignment body (2).
6—Vertical adjustment aperture.
7.—Horizontal adjustment aperture.
8.—Sliding piece for vertical adjustment.
8*a*.—Transverse slot of the sliding piece (8).
9.—Sliding piece for horizontal adjustment.
9*a*.—Transverse slot of the sliding piece (9).
10*a*.—Toothed rack of the sliding piece (8).
10*b*.—Toothed rack of the sliding piece (9).
11*a*.—Transverse slot-shaped aperture of the sliding piece (8).
11*b*.—Transverse slot-shaped aperture of the sliding piece (9).
12.—Vertical toothed adjustment pinion.
13.—Horizontal toothed adjustment pinion.
14.—Fastening screw for fastening the decorative drawer front (16).
15.—Drawer structure.
15*a*.—Front side.
16.—Decorative drawer front.
16*a*.—Fastening aperture.
17.—Active tip.
18.—Indicating grooves.
19*a*.—Safety toothing of the channel (3).
19*b*.—Safety toothing of the sliding piece (8).
20.—Grooves.
21.—Decorative cover.

DESCRIPTION OF A PREFERRED EMBODIMENT

Referring to the drawings and reference numerals listed above, the annexed drawings illustrate a preferred embodiment of the subject of the invention relating to an adjustable connecting device (1) for joining together parts of furniture, of the type used to adjust the decorative front (16) of a drawer or the like, in order to correctly align and secure the position of the decorative front (16) which is coupled to the front side (15*a*) of the drawer structure (15).

FIG. 1 illustrates the subject of the invention, which consists in that, embedded in the front side (15*a*) of the drawer structure (15), at least one adjustable connecting device (1) is provided which is comprised by an alignment body (2) provided with at least one vertical adjustment channel (3) in one of its surfaces (2*a*) which is capable of receiving the sliding piece for vertical adjustment (8); said alignment body (2) having at least one vertical adjustment aperture (6) in its surface (2*a*), which aperture coincides with the position of the toothed rack (10*a*) of the sliding piece for vertical adjustment (8) and is capable of receiving the vertical toothed adjustment pinion (12) whose toothing corresponds to the toothing of the toothed rack (10*a*); said sliding piece for vertical adjustment (8) being provided with the corresponding slot-shaped aperture (11*a*) in the transverse direction and the corresponding toothed rack (10*a*); wherein the adjustment device (1) is completed by the fastening screw (14) for fastening the decorative drawer front (16) which, extending through the slot-shaped aperture (11 *a*) provided in the sliding piece for vertical adjustment (8) and the window (5) of the alignment body (2), secures the decorative drawer front (16). In addition, the adjustable connecting device (1) shown in FIG. 1, within the alignment body (2), includes a horizontal adjustment channel (4) extending through the inside of the alignment body (2) which is capable of receiving the sliding piece for horizontal adjustment (9).

Figure 3:
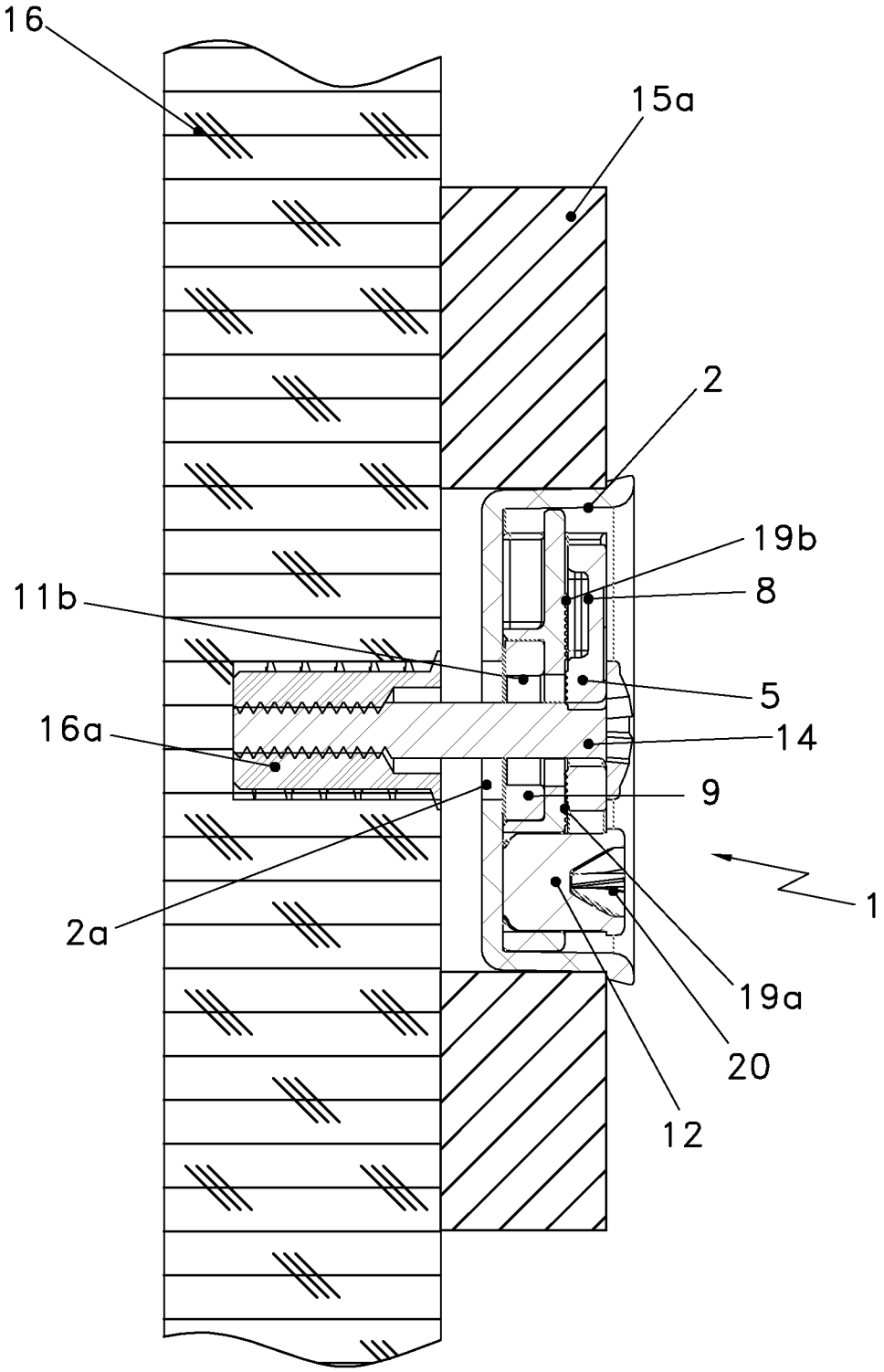
FIG. 3 shows a sectional view along the plane A-A indicated in FIG. 2.

The simple structure and simplicity of mounting is clearly seen in the exploded view of FIG. 1 in which it can be seen that the adjustable connecting device (1) is set up by easy and rapid operations for assembling its parts, without the use of other fastening means, which makes production easier and more cost-efficient. As is seen in FIG. 3, one must only make two fastening apertures (16*a*) in the front side (15*a*) of the drawer structure (15) in which the alignment body (2) is inserted. By using sliding pieces for vertical and horizontal adjustment (8, 9), the position of the drawer front (16) can be correctly aligned in the vertical and horizontal direction by means of two adjustable connecting devices (1). To align the decorative drawer front (16), the fastening screw (14) is loosened to allow movement of the sliding pieces used for adjustment (8, 9). When the toothed adjustment pinions (12, 13) are acted upon, their movement is transmitted to the sliding pieces used for adjustment (8, 9) by means of the toothed racks (10*a*, 10*b*) which move in the horizontal and vertical direction. The two transverse slots (8*a*, 9*a*) create a circle therebetween which coincides with the fastening screw (14) and changes its position as the sliding pieces used for adjustment (8, 9) move, resulting in the adjustment of the decorative drawer front (16). Finally, once the correct position of the decorative drawer front (16) has been found, the fastening screw (14) is tightened again in order to secure said front.

It should be mentioned, as is seen in FIG. 1, that both sliding pieces used for adjustment (8, 9) are geometrically identical, enabling an adjustable connecting device (1) to be obtained which can be maintained more economically, as the parts subjected to wear, sliding pieces (8, 9) and pinions (12, 13) are interchangeable with each other, i.e. only a single type of part has to be produced.

Figure 4:
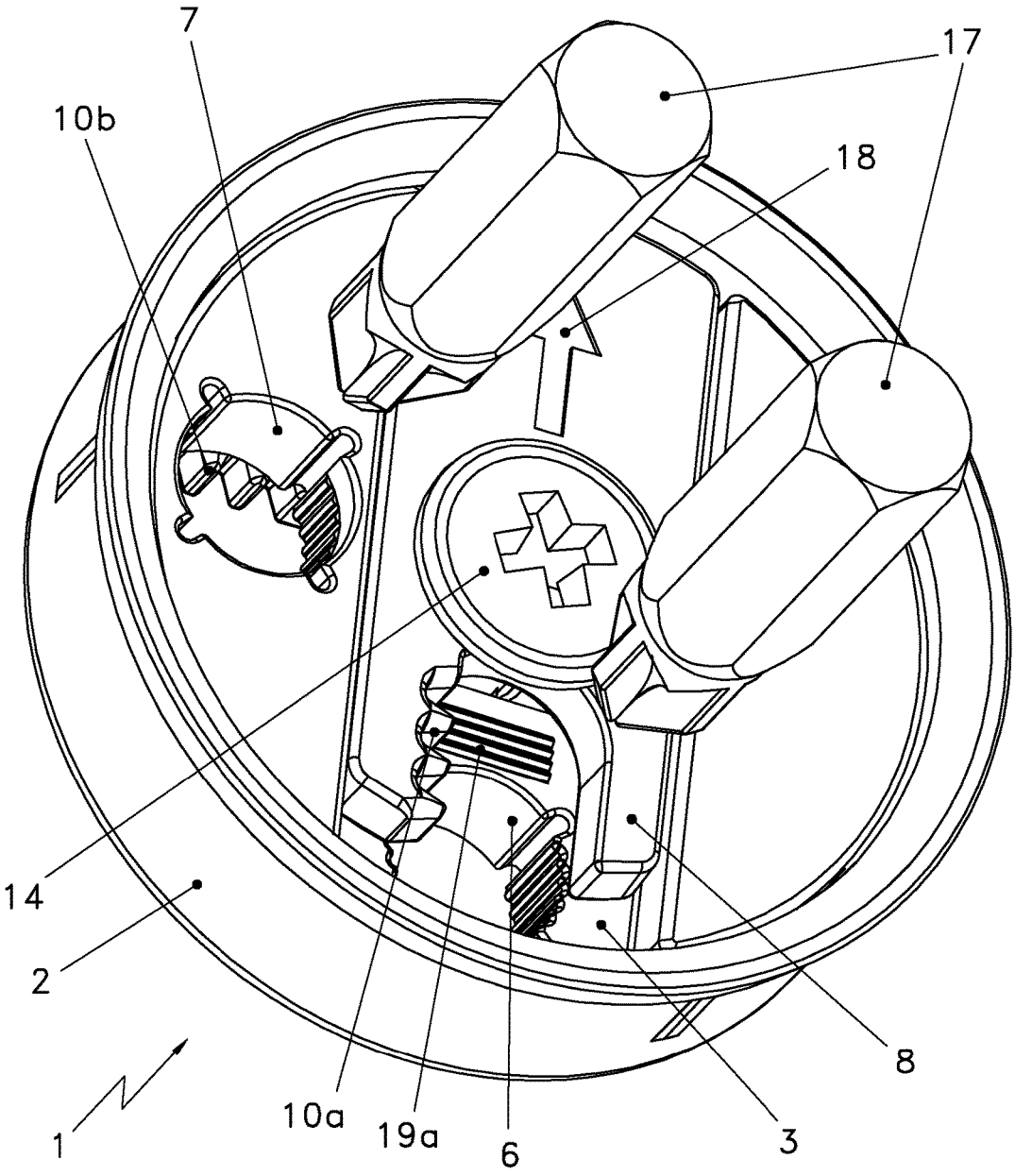
FIG. 4 shows an isometric view of the adjustment device in an embodiment in which the sliding pieces used for adjustment are aligned using the active tip of the corresponding tools, without the need for adjustment pinions.

As is seen in FIGS. 1, 3 and 4, an adjustable connecting device (1) is achieved which is easy to operate; only conventional tightening tools (screwdrivers, Allen key, etc.) are required to act upon the toothed adjustment pinions (12, 13).

It should be mentioned, as is seen in FIG. 3, that by using the fastening screw (14), the decorative front (16) of the drawer (15) can be secured easily and rapidly once it is in the correct position, thus preventing the possibility that it moves out of place again. One must only make two fastening apertures (16*a*) in the decorative front (16), for the reception of the fastening screw (14).

Another advantage of the invention, which is seen in FIGS. 1 and 3, is that at least the bottom of the vertical adjustment channel (3) is provided with a safety toothing (19*a*) which is complementary to the safety toothing (19*b*) provided on the sliding piece for vertical adjustment (8), which are capable of engaging each other when the fastening screw (14) is tightened.

FIG. 3 shows how the toothings (19*a*, 19*b*) will engage once the fastening screw (14) has been tightened, thus preventing the decorative drawer front (16) from moving in the vertical direction due to its own weight in case of large drawers or to improper use by the users.

Another important special feature of the invention, which is seen in FIG. 1, is that the sliding pieces used for adjustment (8, 9) include indicating grooves (18) which indicate the direction of movement of said pieces.

This facilitates detection of the direction of movement of the sliding pieces used for adjustment (8, 9).

Another advantage of the invention, which is seen in FIG. 4, is that, in one embodiment, the toothed racks (10*b*, 10*b*) are actuated by means of active tips (17) of a tool, without the need for vertical and horizontal toothed adjustment pinions (12, 13).

By means of this simplified embodiment, a device comprising a smaller number of elements is obtained, as the vertical and horizontal toothed adjustment pinions (12, 13) are not required, which considerably reduces production and maintenance costs. In addition, work required to mount and align the decorative front (16) is simplified if it is possible to act directly upon the toothed racks (10*a*, 10*b*) of the sliding pieces used for adjustment (8, 9) with a common tool (screwdriver).

Any modifications of the materials, shape, size and arrangement of the component elements which have been described but are non-limiting do not change the essence of this patent.

The invention claimed is:

1. An alignment device for joining together parts of furniture, of the type used to adjust the decorative front of a drawer comprising:

at least one adjustable connecting device having an alignment body provided with at least one vertical adjustment channel which is capable of receiving a sliding piece for vertical adjustment;

the alignment body formed to include at least one vertical adjustment aperture, which coincides with the position of a toothed rack of the sliding piece for vertical adjustment and adapted to receive a vertical toothed adjustment pinion having teeth that mesh with teeth of the toothed rack;

the sliding piece for vertical adjustment formed to include a corresponding slot-shaped aperture in the transverse direction and the corresponding toothed rack; wherein the adjustable connecting device includes a fastening screw for fastening a decorative drawer front which, extending through the slot-shaped aperture provided in the sliding piece for vertical adjustment and a window of the alignment body, secures the decorative drawer front.

2. The alignment device of claim 1, wherein the alignment body is provided with at least one horizontal adjustment channel extending through the inside of the alignment body which is capable of receiving the sliding piece for horizontal adjustment; said alignment body having at least one horizontal adjustment aperture surface in its surface, which aperture coincides with the position of a toothed rack of the sliding piece for horizontal adjustment and is capable of receiving a horizontal toothed adjustment pinion whose toothing corresponds to the toothing of the toothed rack of the sliding piece for horizontal adjustment; a sliding piece for horizontal adjustment being provided with a corresponding slot-shaped aperture in the transverse direction and the corresponding toothed rack; wherein the adjustment device is completed by the fastening screw for fastening the decorative drawer front which, extending through the slot-shaped aperture provided in the sliding piece for horizontal adjustment and the window of the alignment body, secures the decorative drawer front.

3. The alignment device of claim 2, wherein the sliding pieces for vertical and horizontal adjustment are formed to include transverse U shaped slots which include the toothed racks on one of their inner surfaces.

4. The alignment device of claim 2, wherein the sliding pieces for vertical and horizontal adjustment have stepped side surfaces which include the toothed racks, and flat opposite side surfaces.

5. The alignment device of claim 1, wherein at the least the bottom of the vertical adjustment channel is provided with a safety teeth which are complementary to safety teeth provided in the sliding piece for vertical adjustment, which are capable of engaging each other when the fastening screw is tightened.

6. The alignment device of claim 1, wherein the toothed adjustment pinions, in their front surfaces, include grooves corresponding to the active tip of a screwdriver or Allen key.

7. The alignment device of claim 1, wherein the toothed racks can be actuated by use of a tip of a tool.

8. An alignment device for joining together parts of furniture comprising:

a body formed to include a first adjustment channel and a second adjustment channel;

a first slider having teeth and adapted to be slidably positioned within the first adjustment channel;

a second slider having teeth and adapted to be slidably positioned within the second adjustment channel, the body formed to include first and second adjustment body apertures;

a first pinion gear positioned within the first body aperture and adapted to mesh with the teeth on the first slider, wherein rotation of the first pinion gear causes movement of the first slider;

a second pinion gear positioned within the second body aperture and adapted to mesh with the teeth on the second slider, wherein rotation of the second pinion gear causes movement of the second slider;

a fastening screw adapted to extend through the body.

* * * * *